US009416958B2

(12) United States Patent
Yotsumoto et al.

(10) Patent No.: US 9,416,958 B2
(45) Date of Patent: Aug. 16, 2016

(54) ELECTRIC LIGHT BULB TYPE LIGHT SOURCE APPARATUS

(71) Applicant: SONY CORPORATION, Tokyo (JP)

(72) Inventors: Naoki Yotsumoto, Tokyo (JP); Kouji Miyata, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/363,939

(22) PCT Filed: Nov. 30, 2012

(86) PCT No.: PCT/JP2012/007693

§ 371 (c)(1),
(2) Date: Jun. 9, 2014

(87) PCT Pub. No.: WO2013/105169

PCT Pub. Date: Jul. 18, 2013

(65) Prior Publication Data

US 2014/0355246 A1 Dec. 4, 2014

(30) Foreign Application Priority Data

Jan. 10, 2012 (JP) ..... 2012-002223

(51) Int. Cl.

| | |
|---|---|
| ***F21V 33/00*** | (2006.01) |
| ***F21K 99/00*** | (2016.01) |
| ***H04R 1/02*** | (2006.01) |
| ***H05B 37/02*** | (2006.01) |
| ***F21V 23/04*** | (2006.01) |
| *F21V 3/02* | (2006.01) |
| *F21V 23/00* | (2015.01) |

(Continued)

(52) U.S. Cl.

CPC ..... *F21V 33/0056* (2013.01); *F21K 9/1355* (2013.01); *F21V 23/0435* (2013.01); *H04R 1/028* (2013.01); *H05B 37/0272* (2013.01); *F21V 3/02* (2013.01); *F21V 23/006* (2013.01); *F21Y 2101/02* (2013.01); *F21Y 2103/022* (2013.01); *H04R 2201/021* (2013.01)

(58) Field of Classification Search

CPC . F21K 9/1355; F21V 23/006; F21V 33/0052; F21V 33/0056; F21V 3/02; F21Y 2101/02; F21Y 2103/022; H04R 1/028; H04R 2201/021; H05B 37/0272

See application file for complete search history.

(56) References Cited

U.S. PATENT DOCUMENTS 3,194,952 A * 7/1965 Wells ..... 362/86
4,433,363 A * 2/1984 Weber ..... 362/86

(Continued)

FOREIGN PATENT DOCUMENTS

JP 2007-73438 A 3/2007
JP 2011-228130 A 11/2011

(Continued)

OTHER PUBLICATIONS

International Search Report issued Feb. 26, 2013 in PCT/JP2012/007693.

(Continued)

*Primary Examiner* — Mary Ellen Bowman
(74) *Attorney, Agent, or Firm* — Chip Law Group

(57) ABSTRACT

An electric light bulb type light source apparatus capable of ensuring high receiver sensitivity and achieving downsizing without sacrificing light distribution characteristics for lighting.

9 Claims, 6 Drawing Sheets

(51) Int. Cl.

| | |
|---|---|
| *F21Y 101/02* | (2006.01) |
| *F21Y 103/02* | (2006.01) |

(56) References Cited

U.S. PATENT DOCUMENTS

| | | | | |
|---|---|---|---|---|
| 5,163,747 | A * | 11/1992 | Cheng | 362/86 |
| 6,748,096 | B2 * | 6/2004 | Chuang | 381/395 |
| 7,784,957 | B2 * | 8/2010 | Wright | 362/86 |
| 8,299,903 | B2 * | 10/2012 | Haase et al. | 340/326 |
| 8,672,512 | B2 * | 3/2014 | Zhou et al. | 362/255 |
| 2003/0021103 | A1 * | 1/2003 | Christie | 362/86 |
| 2006/0220835 | A1 * | 10/2006 | Kates | 340/539.1 |
| 2007/0097681 | A1 * | 5/2007 | Chich et al. | 362/232 |
| 2007/0109763 | A1 * | 5/2007 | Wolf et al. | 362/86 |
| 2008/0225510 | A1 * | 9/2008 | Rocha | 362/86 |
| 2008/0298045 | A1 * | 12/2008 | Wright | 362/86 |
| 2009/0196016 | A1 * | 8/2009 | Massara et al. | 362/86 |
| 2010/0073944 | A1 * | 3/2010 | Chen | 362/373 |
| 2010/0328946 | A1 * | 12/2010 | Borkar et al. | 362/249.02 |
| 2011/0032708 | A1 * | 2/2011 | Johnston et al. | 362/294 |
| 2011/0309735 | A1 * | 12/2011 | Parker et al. | 313/46 |
| 2012/0126699 | A1 * | 5/2012 | Zittel | 315/86 |
| 2012/0139403 | A1 * | 6/2012 | Johnston et al. | 313/46 |
| 2012/0218978 | A1 * | 8/2012 | Ishidoshiro | 370/338 |
| 2012/0274211 | A1 * | 11/2012 | Xue | 315/35 |
| 2012/0300453 | A1 * | 11/2012 | Zhou et al. | 362/235 |
| 2013/0175923 | A1 | 7/2013 | Yotsumoto et al. | |
| 2013/0181607 | A1 | 7/2013 | Yotsumoto et al. | |
| 2013/0285546 | A1 * | 10/2013 | Chen et al. | 315/50 |
| 2013/0308315 | A1 * | 11/2013 | Capitani et al. | 362/253 |

FOREIGN PATENT DOCUMENTS

| | | | |
|---|---|---|---|
| JP | 2012-227021 | A | 11/2012 |
| WO | WO 2010/140136 | A1 | 12/2010 |
| WO | WO 2012/095016 | A1 * | 7/2012 |

OTHER PUBLICATIONS

U.S. Appl. No. 14/363,168, filed Jul. 5, 2014, Yotsumoto, et al.

* cited by examiner

ELECTRIC LIGHT BULB TYPE LIGHT SOURCE APPARATUS

TECHNICAL FIELD

The present disclosure relates to an electric light bulb type light source apparatus.

BACKGROUND ART

Patent document 1 discloses a LED (Light Emitting Diode) bulb having a radio communication function. This LED bulb has an LED module including a substrate with a plurality of LED elements mounted thereon, a heat sink disposed right under the LED module, and a communication driver module including a circuit substrate housed inside the heat sink with an antenna wire for radio communications. The antenna wire for radio communications is drawn outside of the heat sink and is disposed in a position where it does not block emitted light of the LED elements (see, for example, paragraphs 0018, 0024 and 0036 in the specification and FIGS. 2 and 3 of Patent Document 1).

Patent Document 1: Japanese Patent Application Laid-open No. 2011-228130

DISCLOSURE OF THE INVENTION

Problem to be Solved by the Invention

However, to actually provide the antenna wire to the LED bulb described in Patent Document 1 in the position and posture that the antenna wire does not block the emitted light of the LED elements, the height of the antenna from the heat sink would be made lower than the position where the LED elements are disposed. There may be a problem that receiver sensitivity of the antenna to radio signals would deteriorate when the height of the antenna is lowered. If the position where the LED elements are disposed is made higher, it would be difficult to obtain light distribution characteristics suitable for a light source for illuminating, and it would be difficult to achieve downsizing which is demanded for the electric light bulb type light source apparatus.

In view of the above-mentioned circumstances, an object of the present disclosure is to provide an electric light bulb type light source apparatus capable of ensuring high receiver sensitivity and achieving downsizing without sacrificing its light distribution characteristics when serving as a light source for illuminating.

Means for Solving the Problem

In order to achieve the object described above, an electric light bulb type light source apparatus according to the present disclosure includes a light source unit, a casing, a circuit substrate and a base.

The light source unit has a void area.

The casing has a conductive outer case and a translucent cover. The casing is configured to house the light source unit. The conductive outer case forms a first area in the casing. The translucent cover forms a second area in the casing. The second area is opposed to the first area. The translucent cover is opposed to the conductive outer case.

The circuit substrate at least has an antenna mounted thereon. The antenna is configured to receive a radio signal from an outside of the casing. The circuit substrate is housed in the casing. The circuit substrate is provided penetrating through the void area in such a manner that the antenna is disposed in the second area.

The base is disposed on a side of the conductive outer case, which side is opposite to a side on which the translucent cover is provided. The base is used for supplying power to the light source unit.

The circuit substrate can be arranged efficiently within a small space inside the casing, by utilizing both areas of the translucent cover and the conductive outer case by being disposed penetrating through the void area of the light source unit. Further, as the circuit substrate does not block the light emitted from the light source unit, it is possible to reduce influence on light distribution characteristics. The antenna out of this circuit substrate which is disposed in the area within the translucent cover can receive the radio signal without being shielded by the conductive outer case. Therefore, it is possible to ensure high receiver sensitivity and achieve downsizing of the apparatus, without sacrificing its light distribution characteristics when serving as a light source for illuminating.

The electric light bulb type light source apparatus may further include a speaker and a speaker drive circuit. The speaker drive circuit is configured to drive the speaker by the power supplied from the base. Such an electric light bulb type light source apparatus that includes a speaker is also able to achieve high receiver sensitivity and downsizing, without affecting the placement of the speaker by the installation position of the antenna.

The circuit substrate has a control circuit mounted thereon. The control circuit is configured to at least control the speaker drive circuit on the basis of the radio signal received by the antenna. The speaker drive circuit may be configured to drive the speaker on the basis of sound information contained in the radio signal received by the antenna. This allows the speaker of the electric light bulb type light source apparatus to be controlled by wireless information.

The electric light bulb type light source apparatus may further include a light source drive circuit configured to drive the light source unit. The circuit substrate may have a control circuit mounted thereon. The control circuit is configured to at least control the light source drive circuit on the basis of the radio signal received by the antenna. This allows the lighting function of the electric light bulb type light source apparatus to be controlled by wireless information.

The light source unit may include a mounting substrate which has a light source element mounted thereon, which mounting substrate may have a through hole as the void area. By providing the through hole as the void area, it allows the circuit substrate to be placed in the position surrounded by the light source unit, so as not to form shadow by a part of the circuit substrate, which part is disposed in the area within the translucent cover.

The light source unit may have an LED (light emitting diode) or an EL (electro luminescence) element as the light source element.

Effects of the Invention

As described above, according to the present disclosure, it is possible to ensure high receiver sensitivity and achieve downsizing of the apparatus, without sacrificing its light distribution characteristics when serving as a light source for illuminating.

MODE(S) FOR CARRYING OUT THE INVENTION

Hereinafter, some embodiments of the present disclosure will be described with reference to the drawings.

[Overall Structure of Electric Light Bulb Type Light Source Apparatus]

Figure 1:
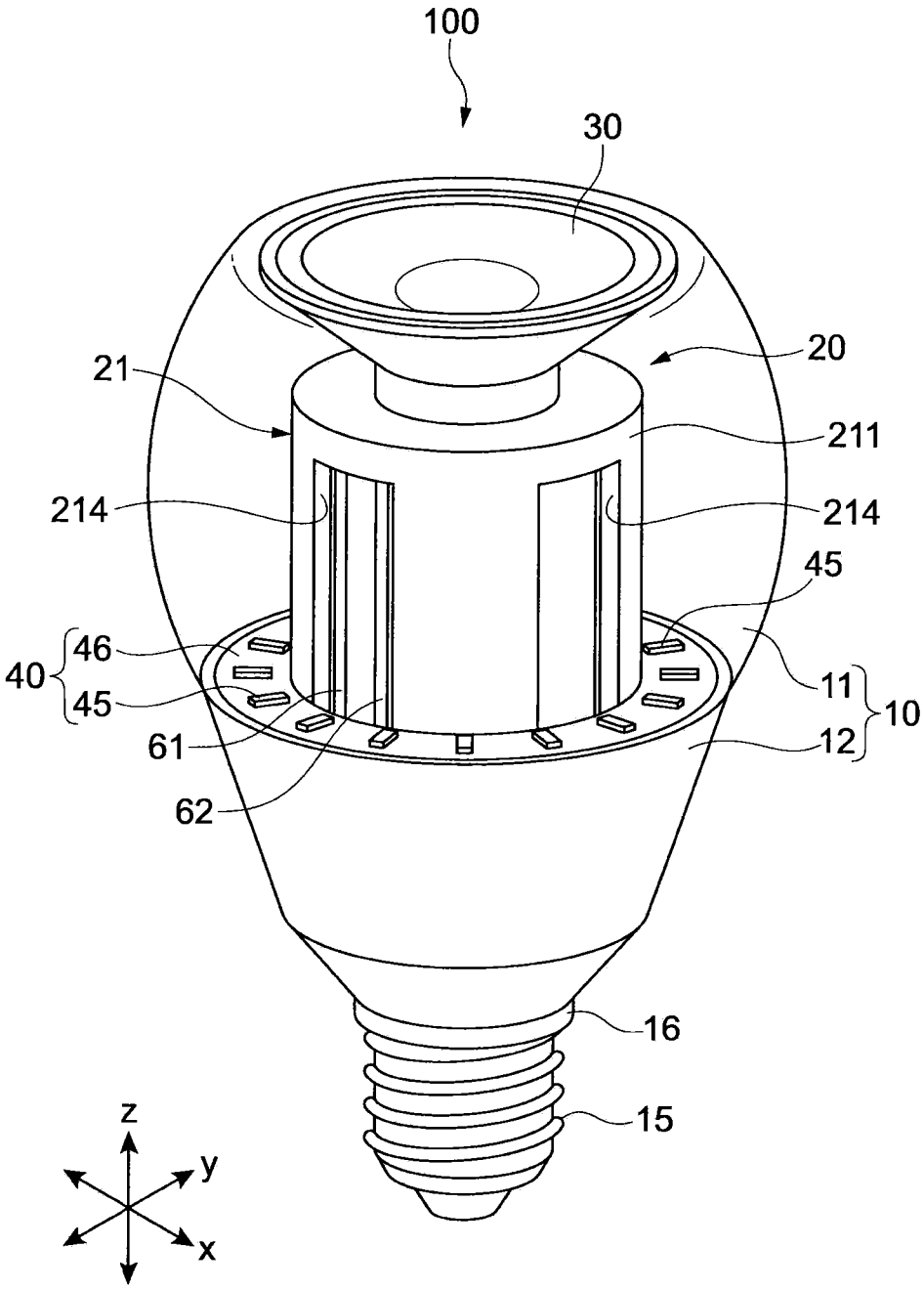
FIG. 1 A perspective view showing an electric light bulb type light source apparatus according to an embodiment of the present disclosure.
Figure 2:
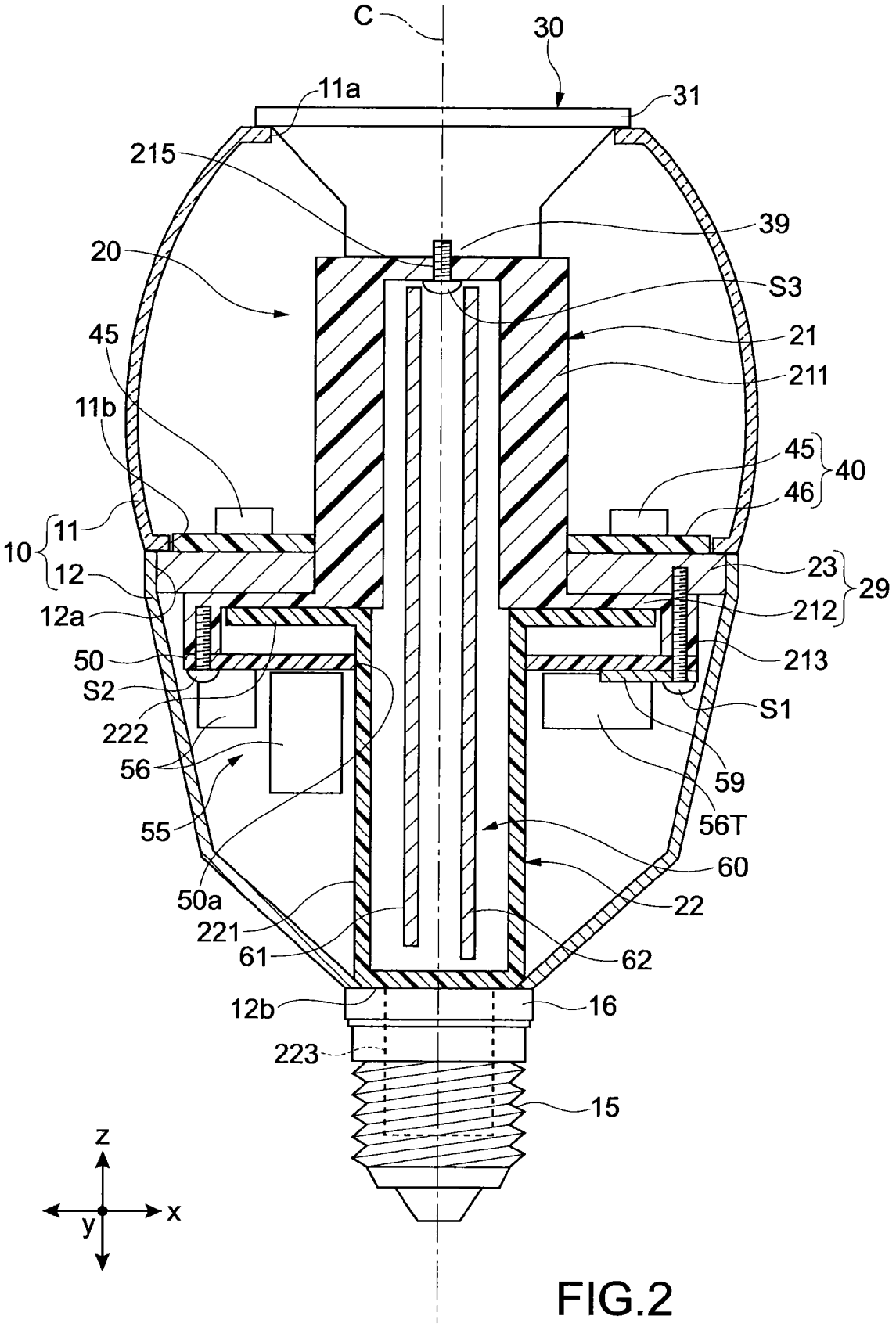
FIG. 2 A schematic cross-sectional view showing the electric light bulb type light source apparatus shown in FIG. 1.

FIG. 1 is a perspective view showing an electric light bulb type light source apparatus 100 according to an embodiment of the present disclosure. FIG. 2 is a schematic cross-sectional view showing the electric light bulb type light source apparatus 100 shown in FIG. 1. In the following description, the electric light bulb type light source apparatus is simply referred to as a light source apparatus.

The light source apparatus 100 is provided with a casing 10, a light source unit 40 housed in the casing 10, a speaker 30 provided on one end portion of the casing 10, and a base 15 connected to the other end portion (opposite side to the position of the speaker 30) of the casing 10 with an electrically insulating ring 16 disposed therebetween.

For convenience of explanation, in the following, it is assumed that a direction along a z axis in FIGS. 1 and 2 is a back-and-forth direction of the light source apparatus 100, and specifically, the speaker 30 side corresponds to a front side, and the base 15 side corresponds to a rear side.

The casing 10 has, for example, a base casing 12 and a translucent cover 11 facing the base casing 12. As shown in FIG. 2, the translucent cover 11 has a first opening portion 11*a* formed on an end portion on the front side and a second opening portion 11*b* formed on the opposite side thereto along the z axis direction. The speaker 30 is attached to the translucent cover 11 so as to block the first opening portion 11*a*. On the side of the second opening portion 11*b* of the translucent cover 11, the base casing 12 is provided. The translucent cover 11 may be made of, for example, glass, acrylic, or polycarbonate.

The light source apparatus 100 is provided with a support unit 20 that supports the speaker 30. The support unit 20 integrally supports the light source unit 40, the speaker 30, and the base 15 so that the speaker 30 and the light source unit 40 is separated from each other, and the light source unit 40 is disposed between the speaker 30 and the base 15. As shown in FIG. 2, typically, the support unit 20 has a heat sink 23, a holding member 21 that is fixed to the heat sink 23 and holds the speaker 30, and a substrate containing box 22 that is disposed so as to be opposed to the holding member 21.

The heat sink 23 of the support unit 20 functions as a chassis of the light source apparatus 100. The heat sink 23 is disposed around a center axis C (see FIG. 2), which is an axis that passes through the center of the speaker 30 along a vibration direction (z axis direction) of a diaphragm 35 (see FIG. 3) included in the speaker 30. The area indicated by the term "around the axis" includes the entire circumference of the axis and a part thereof. Typically, the heat sink 23 has a plate shape and is formed around the entire circumference of the center axis C, that is, formed into a ring shape.

The light source unit 40 is also disposed around the center axis C like the heat sink 23 and is typically formed into a ring shape and disposed on the heat sink 23. For example, the light source unit 40 has a ring-shaped mounting substrate 46 and a plurality of LED (light emitting diode) elements 45 arranged in a ring form on the mounting substrate 46. For one LED element 45, an element that generates white light is used, but an element that generates light of a single color other than white or a plurality of colors may be used.

The heat sink 23 is mainly made of aluminum, for example. However, the heat sink 23 may be made of other metal materials such as copper, as long as the material has high thermal conductivity. Otherwise, the heat sink 23 may be made of ceramics or a heat-dissipating resin. Incidentally, the heat sink 23 is electrically-conductive, and the heat sink 23 may be electrically connected to a power source circuit 55 which will be described later.

The base 15 is formed so as to be mountable on a socket of a general incandescent light bulb. The base 15 is disposed on the base casing 12, on the side opposite to the side on which the translucent cover 11 is provided. The base 15 is a member that supplies power to a circuit substrate 60 on which various circuits are mounted, the light source unit 40, and the speaker 30 via a power source circuit 55 which will be described later.

The length of the light source apparatus 100 in the z axis direction is 100 to 120 mm, typically about 110 mm. The diameter of the light source apparatus 100 viewed in the z axis direction is 50 to 70 mm, typically about 60 mm.

[Specific Structure of Speaker]

Figure 3:
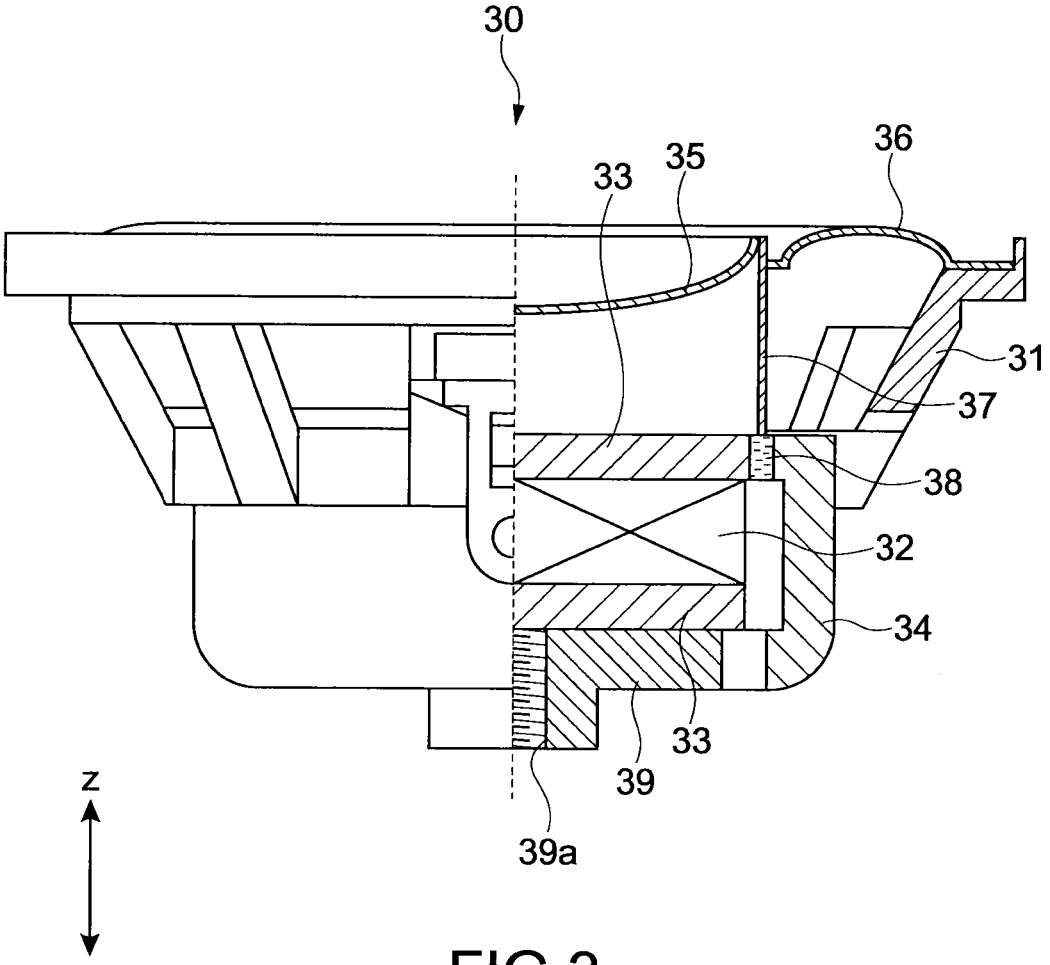
FIG. 3 A cross-sectional view showing a speaker according to the embodiment.

FIG. 3 is a cross-sectional view showing the speaker 30 according to the embodiment. The speaker 30 is a dynamic type damperless speaker. The speaker 30 is provided with a frame 31, a permanent magnet 32, a plate 33, a yoke 34, the diaphragm. 35, an edge 36, a coil bobbin 37, a magnetic fluid 38, and an attachment bottom portion 39.

Instead of a damper in related art, the magnetic fluid 38 is provided in a magnetic gap between the yoke 34 and the plate 33 on the upper side thereof. Further, in the magnetic gap, a voice coil (not shown) is provided. On the attachment bottom portion 39, a threaded hole 39*a* is formed. As will be described later, through the threaded hole 39*a*, the speaker 30 is attached to the holding member 21 of the support unit 20 with a screw S3 (see FIG. 2).

As will be described later, in this embodiment, because the speaker 30 and the light source unit 40 are disposed separately from each other, the speaker 30 is unlikely to be affected by heat of the light source unit 40. Therefore, as the permanent magnet 32 used for the speaker 30, a permanent magnet having a relatively low heat resistance, that is, relatively low demagnetization temperature can be used. For example, a permanent magnet having the demagnetization temperature of 60° C. to 100° C. (inclusive) can be used. As the permanent magnet having the demagnetization temperature of 100° C. or less, neodymium can be used, for example.

The magnetic force of a neodymium magnet is higher than that of a ferrite core magnet or the like, and the demagnetization temperature of the neodymium is about 80° C., which is lower than that of ferrite. In the case where the ferrite core magnet is applied to the speaker 30 of the light source apparatus 100 according to this embodiment, to obtain a magnetic force equivalent to the magnetic force of the neodymium magnet, the size of the ferrite core magnet has to be increased, which is not suitable for the downsizing of the light source apparatus 100. It is also thought that a heat generation quantity of the light source unit 40 is reduced so as not to demagnetize the permanent magnet, but this means that input power to the light source apparatus 100 is suppressed, which reduces a light flux quantity.

In view of the above, in this embodiment, neodymium having a lower heat resistance and a larger magnetic force than ferrite is used, and the speaker 30 and the light source unit 40 is disposed so as to be separated from each other, with the result that the above problem is overcome.

For example, at least a part of the frame 31 of the speaker 30 and at least a part of the edge 36 may be made of a translucent material. As the translucent material, a known material such as an acrylic-based resin material, a polyvinyl-based resin material, and a polyimide-based resin material is used. Thus, light emitted from the light source unit 40 passes through a part of the speaker 30, with the result that it is possible to increase light distribution characteristics leaning to the center of the light source apparatus 100.

[Specific Structure of Support Unit]

Figure 4:
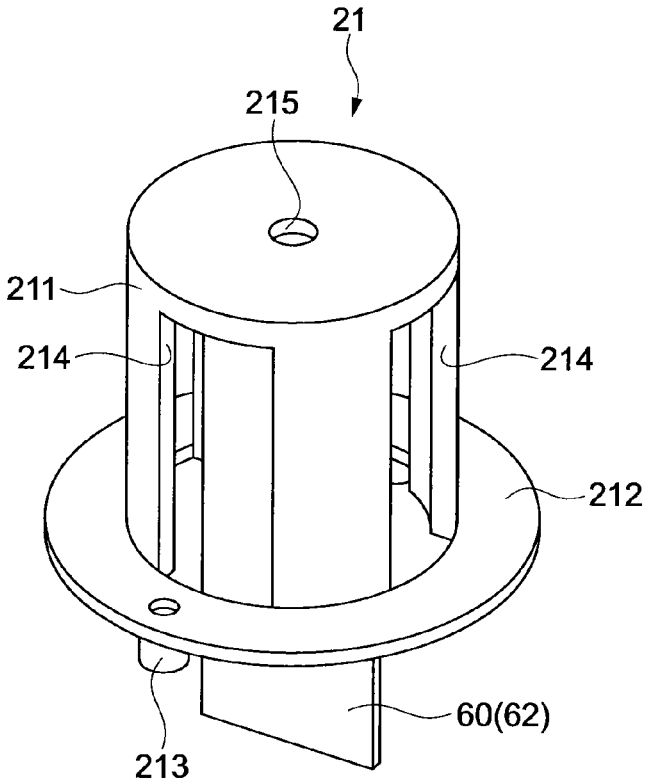
FIG. 4 A perspective view showing a holding member of a support unit.

FIG. 4 is a perspective view showing the holding member 21 of the support unit 20. The holding member 21 has a tubular portion 211 to which the speaker 30 is attached and a flange portion 212 provided on an end portion on the rear side of the tubular portion 211. The holding portion 21 is disposed in the casing 10 so that the tubular portion 211 passes through the center hole of the heat sink 23 and the light source unit 40, and a longitudinal direction of the tubular portion 211 is extended along the z axis direction.

On an end surface on the front side of the tubular portion 211, a threaded hole 215 is formed. In the threaded hole 215 and the threaded hole 39*a* which is formed in the speaker 30, the screw S3 (see FIG. 2) is screwed. With this structure, the speaker 30 is held by the holding member 21. The way of attaching the speaker 30 to the holding member 21 is not limited to the screwing, and bonding with an adhesive or engagement with an uneven member may be used.

As shown in FIG. 2, the holding member 21 is attached to the heat sink 23 with a screw S1. Specifically, on the flange portion 212 of the holding member 21, an attachment portion 213 for screwing is formed so as to be projected toward the rear side. The heat sink 23 is placed on the flange portion 212, and the holding member 21 is attached to the heat sink 23 through the attachment portion 213 from the back surface side (rear side) of the heat sink 23.

With the structure of the holding member 21 and the heat sink 23 as described above, because the light source unit 40 is disposed separately from the speaker 30 to the rear side thereof as described above, it is possible to suppress the influence of heat from the light source unit 40 to the speaker 30. As a result, it is possible to desirably maintain the function of the speaker 30. For example, in the case where the influence of heat to the speaker 30 is large, there is a problem in that the demagnetization of the permanent magnet 32 provided to the speaker 30 may occur, but by the light source apparatus 100 according to this embodiment, it is possible to overcome such a problem.

Further, the speaker 30 is disposed on the side from which light of the light source unit 40 is emitted, that is, on a position where the emitted light may be blocked. The light source unit 40 is provided in a ring-shaped form, thereby increasing a light distribution angle. Furthermore, the light source unit 40 can emit light with the light distribution as a uniform light quantity with respect to the center axis C.

In this embodiment, the holding member 21 that holds the speaker 30 is disposed so as to be surrounded by the light source unit 40. Therefore, it is possible to reduce the disposition space of the holding member 21 and the light source unit 40 in the electric light bulb type light source apparatus 100, that is, it is possible to increase the disposition density of these members, which can achieve the downsizing of the light source apparatus 100 while ensuring a desired light distribution angle.

To the tubular portion 211 of the holding member 21, a reflection portion that reflects light emitted from the light source unit 40 may be provided. The reflection portion is a part formed of a mirror surface or a material having color with a high light reflectance, for example. The color with the high reflectance refers to white, milky while, or color close to those, for example. Of course, the holding member 21 itself may be formed of a white or milky while resin material. As the resin material, ABS (acrylonitrile butadiene styrene), PBT (polybutylene terephthalate), or the like is used, but it is also possible to use other materials therefor. The reflection portion may also be provided as a separate member from the tubular portion 211 of the holding member 21.

In addition, in the case where the reflection portion is formed of a white or milky white material, for example, the reflection portion can diffusely reflect (scatter) light. Alternatively, when the reflection portion has a reflection surface that is subjected to a blast process, the reflection surface also can diffusely reflect light.

As described above, by providing the reflection portion, it is possible to increase the light distribution angle of light emitted from the light source unit 40 and effectively use light from the light source unit 40, which can increase the intensity of illumination.

Figure 5:
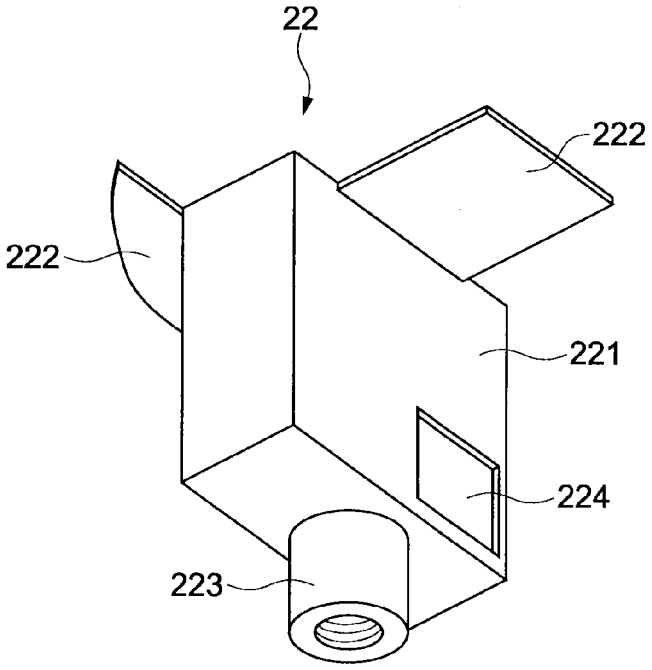
FIG. 5 A perspective view showing a substrate containing box of the support unit viewed from below.

FIG. 5 is a perspective view showing the substrate containing box 22 of the support unit 20 viewed from below. The substrate containing box 22 has a main body 221, a plurality of contact plates 222, and a projection portion 223. The contact plates 222 are projected in a direction perpendicular to the z axis from the main body 221, and the projection portion 223 is projected in the z axis direction from the main body 221. In FIG. 5, the plurality of contact plates 222 having different shapes are provided, but only one contact plate 222 may be provided.

Further, in the main body 221, a connection hole portion 224 to which a connector for conduction (not shown) is connected is formed. A plurality of connection hole portions 224 may be formed.

As shown in FIG. 2, the main body 221 is uprightly provided along the z axis direction, and the holding member 21 and the substrate containing box 22 are disposed in the casing 10 so as to be opposed to each other so that the contact plates 222 are in contact with the flange portion 212 of the holding member 21. In an area formed in the holding member 21 and the substrate containing box 22 disposed as described above, that is, in an area in the tubular portion 211 and the main body 221, some circuit substrates 60 are disposed. A plurality of circuit substrates 60, for example, two circuit substrates 60 may be provided (drive substrate 61 and control substrate 62). As will be described later, the drive substrate 61 is provided as a common substrate on which an LED drive circuit 614 and an audio amplifier (AMP) 613 (see FIG. 7) to be described later are mounted.

The projection portion 223 is disposed in the base 15 so as to be inserted in an opening end portion 12*b* on the rear side of the base casing 12, as shown in FIG. 2. The projection portion 223 is formed in a tubular form and disposed so that a lead (not shown) that connects a terminal of a top portion of the base 15 and a power source substrate 50 to be described later with each other passes through the inside of the projection portion 223.

Like the holding member 21, the substrate containing box 22 is formed of a nonconductive material, for example, an ABS resin material mainly. In this way, a desirable material as an electrically insulating material and a fire-retardant material is used for the holding member 21 and the substrate containing box 22.

In the tubular portion 211 of the holding member 21, a plurality of openings 214 are formed. As a result, in the casing 10, via the openings 214, an external area of the tubular portion 211 of the holding member 21 is communicated with an area in the tubular portion 211 and the substrate containing box 22. With this structure, in the casing 10, it is possible to use not only the external area of the tubular portion 211 but also the area in the tubular portion 211 and the substrate containing box 22 as an enclosure of the speaker 30. As a result, the volume of the enclosure becomes larger, which improves the sound quality of the speaker 30. It should be noted that it is also possible to have only one opening 214 formed in the tubular portion 211.

The base casing 12 is formed of a material having relatively high thermal conductivity, for example, mainly aluminum. As a material of the base casing 12, any other metal material such as copper may be used as long as the material has high thermal conductivity. Alternatively, a material of the base casing 12 may be a heat-dissipating resin or ceramics. Incidentally, the base casing 12 is electrically-conductive, and the base casing 12 may be electrically connected to a power source circuit 55 which will be described later. The heat sink 23 and the base casing 12 are thermally connected with each other. As shown in FIG. 2, for example, an opening end portion 12*a* formed on the base casing 12 and a side surface of the heat sink 23 are in contact with each other directly or through a heat conductive sheet or the like, thereby causing heat conduction between the members. As a result, heat generated from the light source unit 40 is efficiently radiated to the outside via the heat sink 23 and the base casing 12.

It should be noted that the heat sink 23 and the base casing 12 may be formed of different main materials.

With reference to FIG. 2, the translucent cover 11 is disposed with respect to the base casing 12 so that an opening surface of the opening end portion 12*a* of the base casing 12 and an opening surface of the second opening portion 11*b* of the translucent cover 11 face each other. The support unit 20 supports the speaker 30 so that the translucent cover 11 is pressed against the heat sink 23 with the speaker 30, and the speaker 30 and the support unit 20 sandwich the translucent cover 11.

The heat sink 23 mainly forms a base portion 29 of the support unit 20. The base portion 29 of the support unit 20 includes the flange portion 212 of the holding member 21. Further, the base portion 29 of the support unit 20 may include the base casing 12.

As described above, the speaker 30 supported by the support unit 20 sandwiches the translucent cover 11 with the heat sink 23 and supports the translucent cover 11 with the translucent cover 11 pressed against the heat sink 23. Thus, it is not necessary to directly fix the translucent cover 11 to the heat sink 23 and the speaker 30. Therefore, even if the translucent cover 11 having a thermal expansion coefficient different from the thermal expansion coefficients of the heat sink 23 and (the frame 31 of) the speaker 30 is thermally expanded due to a temperature change of the light source unit 40, deformation due to the thermal expansion at the opening portions 11*a* and 11*b* that face the speaker 30 and the heat sink 23, respectively, is tolerated, and it is possible to let a stress of the thermal expansion get away. Thus, it is possible to suppress such an accident that a mechanical stress is generated in the translucent cover 11, and the translucent cover 11 deteriorates.

[Structures of Various Circuit Substrates]

As shown in FIG. 2, in the base casing 12, the power source substrate 50 on which the power source circuit 55 is mounted is contained. The power source substrate 50 is attached to the holding member 21 with a screw S2. Further, with the screw S1 that connects the holding member 21 and the heat sink 23 with each other, the power source substrate 50 is also attached to the heat sink 23.

Here, in general, in the viewpoint of suitability of an LED light bulb to a lighting apparatus, the shape of the LED light bulb is desired to be close to the shape of an incandescent light bulb, and the LED light bulb is desired to be downsized as much as possible. If a product size of the LED light bulb is significantly large, the quality of the product is degraded. In the case where the power source substrate and a drive circuit substrate of the LED are disposed on the same plane or disposed along a parallel plane, the product size is increased, and an outer circumferential size of a casing in the vicinity of a base is also increased. In the viewpoint of the suitability to a lighting apparatus, it is ideal to achieve an LED light bulb having the outer circumferential size of the casing in the vicinity of the base which is close to that of the incandescent light bulb. Therefore, in such a viewpoint, a product in which the power supply substrate and another circuit substrate are disposed on the same plane as described above leads to the degradation of the quality of the product. In view of this, in the present disclosure, the circuit substrates are disposed as follows.

Figure 6:
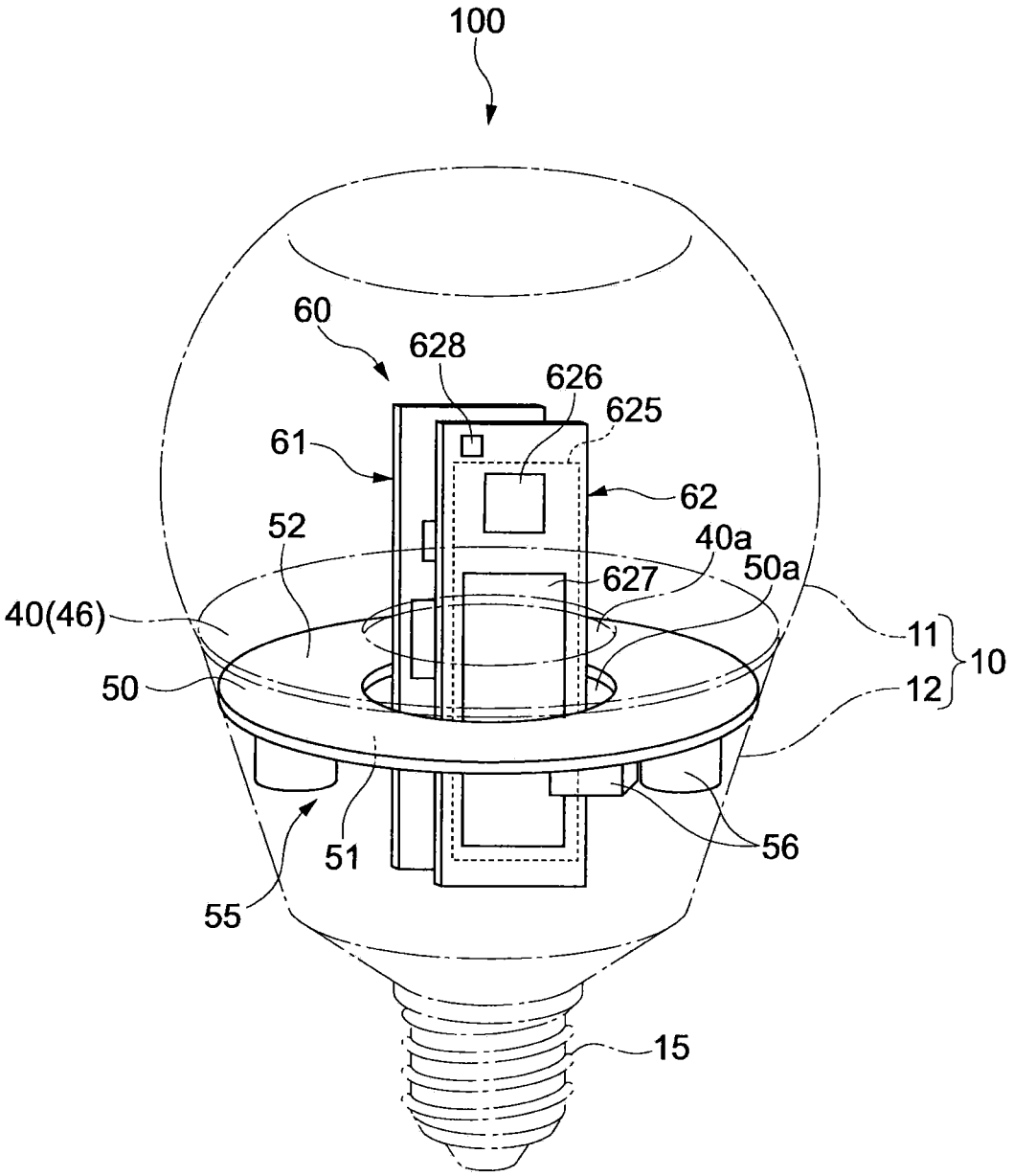
FIG. 6 A diagram showing a disposition relationship between a power source substrate and other circuit substrates (drive substrate and control substrate).

FIG. 6 is a diagram showing a disposition relationship between the power source substrate 50 and the circuit substrates 60 (drive substrate 61 and control substrate 62 as described above). The power source substrate 50 has a void area 50*a*, and the drive substrate 61 and the control substrate 62 are partly disposed in the void area 50*a*.

Typically, the void area 50*a* is formed of a through hole, that is, the power source substrate 50 is formed into a ring shape. Specifically, as shown in FIG. 2, in the void area 50*a*, the main body 221 of the substrate containing box 22 is inserted. As a result, the drive substrate 61 and the control substrate 62 disposed in the holding member 21 and the substrate containing box 22 are disposed so as to perpendicularly cross the power source substrate 50 through the through hole of the power source substrate 50.

As described above, the drive substrate 61 and the control substrate 62 are disposed so as to be inserted in the through hole of the power source substrate 50, so it is possible to efficiently dispose components in the small containing space of the casing 10 and achieve the downsizing of the light source apparatus 100.

Specifically, an envelope shape of the entire substrates disposed as described above approaches the shape obtained by disposing two schematic triangular shapes oppositely to each other along the z axis direction. The shape approaches an outline of the casing 10 in which the base casing 12 and the translucent cover 11 are fitted when the light source apparatus 100 is viewed from the side. That is, by disposing the substrates 50, 61, and 62 as described above, it is possible to increase the density of the components in the casing 10, which can downsize the light source apparatus 100.

Further, it is possible to densely dispose the substrates 50, 61, and 62 in the casing 10, so the volume of the speaker 30 as the enclosure can be sufficiently ensured, which can improve the sound quality of the speaker 30.

As shown in FIG. 6, on the control substrate 62 of the circuit substrates 60, a receiving unit (or light receiving unit) 628, an antenna 626, and a network control circuit 627 are mounted.

Typically, the antenna 626 is an antenna for near field communication such as Bluetooth. Further, the network control circuit 627 is compliant with the communication standard.

Now, with reference to FIG. 6, a disposition relationship among the casing 10, the light source unit 40 and the circuit substrates 60 will be described. The base casing 12 is formed as a conductive outer case which forms an exterior of an area on the rear side (first area) from the light source unit 40. The translucent cover 11 forms an exterior of an area on the front side (second area) from the light source unit 40, being opposed to the first area in the casing 10. Thus, the apace in the casing 10 is divided in two areas by the position where the light source unit 40 is disposed, which two areas are: the area in the base casing 12 where the radio signal is shielded; and the area in the translucent cover 11 where the radio signal can be received. The above-described ring-shaped mounting substrate 46 forms a void area 40*a* of the light source unit 40, in a form of a through hole. The circuit substrates 60 can be arranged efficiently within a small space inside the casing 10, by utilizing both areas of the translucent cover 11 and the conductive outer case 12 by being disposed penetrating through the void area 40*a*.

With such a way of arrangement, the position and posture of the control substrate 62 on which the antenna 626 is mounted can be set in such a manner that the antenna 626 would be disposed in an area within the translucent cover 11 (area on the front side with respect to the light source unit 40). Thus, the antenna 626 is able to receive the radio signal without being shielded by the base casing 12. In addition, since the position of the circuit substrates 60 is surrounded by the light source unit 40, the circuit substrates 60 do not block the light emitted from the light source unit 40. As a result of the above, regarding the electric light bulb type light source apparatus 100, it is possible to ensure high receiver sensitivity and achieve downsizing of the apparatus, without sacrificing its light distribution characteristics when serving as a light source for illuminating.

The network control circuit 627 functions, as will be described later, as a control circuit for controlling an audio amplifier (AMP) 613 (see FIG. 7) as a speaker drive circuit, on the basis of the radio signal received by the antenna 626. This allows the speaker 30 to be controlled by radio signal information. For example, an AV (audio video) apparatus serving as an apparatus to be operated by the user transmits a radio signal, and the antenna 626 receives the radio signal. For example, the signal transmitted from the AV apparatus is a signal of a sound volume of sound from the speaker 30, reproduction and stop thereof, and the like. As the AV apparatus, a portable apparatus may be used.

It should be noted that the antenna 626 and the network control circuit 627 may be compliant with the communication standard for constructing WiFi (wireless fidelity), ZigBee, a wireless LAN (local area network), or the like, in addition to Bluetooth.

The receiving unit 628 receives an infrared signal transmitted from a remote controller (not shown) which can be used by a user. The position and posture of the control substrate 62 are set so that the receiving unit 628 is disposed on a position where the infrared signal can be received, that is, disposed in an area (area on the front side of the light source unit 40) in the translucent cover 11 in the casing 10. For example, the receiving unit 628 is mounted on an end portion on the front side of the control substrate 62. The remote controller (not shown) is an apparatus that generates signals for turning-on and -off, dimming, and toning of the light source unit 40, and the like.

The power source substrate 50 has a first surface 51 that is opposed to the base 15 side and a second surface 52 that is opposed to the light source unit 40 side. Further, the power source circuit 55 mounted on the power source substrate 50 has a transformer 56T (see FIG. 2) including a primary side coil and a secondary side coil and a primary side electronic component 56 electrically connected to the primary side coil. The transformer 56T and the primary side electronic component 56 are mounted on the first surface 51 of the power source substrate 50.

As described above, the transformer 56T and the primary side electronic component 56 each having a relatively large size are disposed on the base 15 side of the power source substrate 50, thereby making it possible to dispose a component different from the power source circuit 55, for example, a part of the light source unit 40 and the support unit 20 in a space on the front side of the second surface 52. As a result, it is possible to effectively use a small space in the casing 10 (or base casing 12).

[Electrical Structure of Light Source Apparatus]

Figure 7:
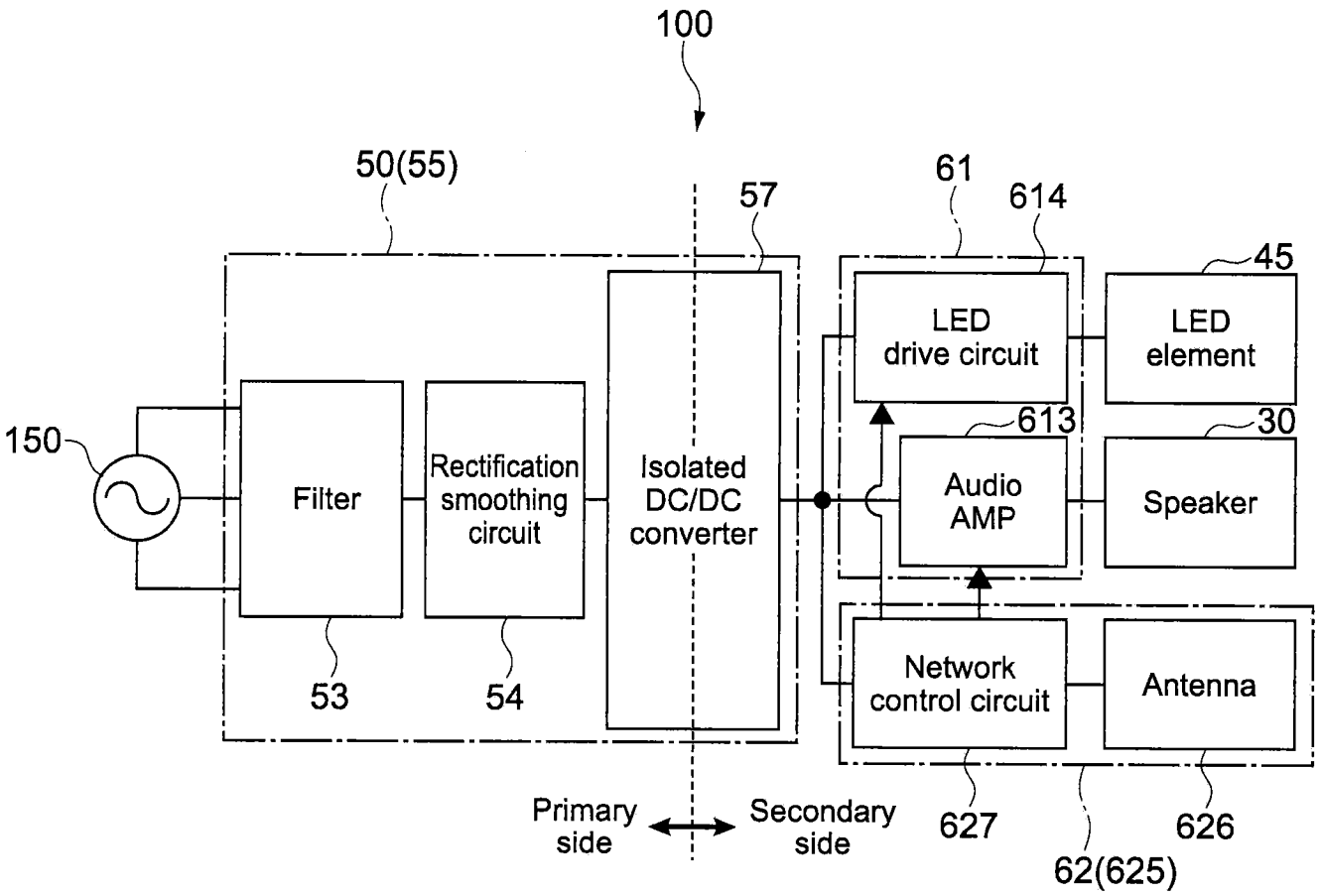
FIG. 7 A block diagram showing an electrical structure of the light source apparatus.

FIG. 7 is a block diagram showing an electrical structure of the light source apparatus 100.

The light source apparatus 100 is provided with a filter 53, a rectification smoothing circuit 54, an isolated DC/DC converter 57, the LED drive circuit 614, the audio AMP 613, the network control circuit 627, and the antenna 626. A commercial power source 150 supplies power to the power source circuit 50 via the base 15 of the light source apparatus 100.

The filter 53, the rectification smoothing circuit 54, and the isolated DC/DC converter 57 are the power source circuits 55 and are mounted on the power source substrate 50 as described above. The isolated DC/DC converter 57 includes the transformer 56T. For the power source circuit 55, the isolated DC/DC converter 57 is used to electrically insulate the primary side circuit and the secondary side circuit from each other.

The LED drive circuit 614 and the audio AMP 613 are mounted on the drive substrate 61 as described above. The LED drive circuit 614 performs control for turning-on and -off, dimming, and toning of the light source unit 40, and the like. The audio AMP 613 is the drive circuit of the speaker 30 and controls a sound volume of sound from the speaker 30, reproduction and stop thereof, and the like.

As described above, the network control circuit 627 and the antenna 626 are a part of a control circuit 625 and are mounted on the control substrate 62. The network control circuit 627 outputs, to the LED drive circuit 614 and the audio AMP 613, content information of a signal received via the receiving unit 628 and the antenna 626.

[Structure of Ground Connection of Electric Circuit]

As shown in FIG. 2, on the first surface 51 of the power source substrate 50, a secondary side ground connection pattern 59 is formed. The ground connection pattern 59 is conducted with the heat sink 23 and the base casing 12 via the screw S1. That is, the heat sink 23 and the base casing 12 serve as electrical grounds for the power source circuit 55.

As described above, in this embodiment, an insulated power source circuit is used, and the secondary side circuit thereof is grounded. Therefore, it is possible to obtain an appropriate EMS (electromagnetic susceptibility) without generating an EMI (electromagnetic interference) or the like, with the result that the condition of an EMC (electromagnetic compatibility) can be satisfied. In other words, according to the present technology, it is possible to suppress the leakage of high frequency noises from the drive substrate 61 or the like and suppress the leakage of radiation noises from the speaker 30. Further, it is of course possible to prevent exogenous noises from entering the base casing 12.

Further, in this embodiment, members that form a ground potential are the heat sink 23 and the base casing 12 that function as the heat radiation members. That is, the heat sink 23 and the base casing 12 are each equipped with the functions of the ground potential formation and the heat radiation, and therefore it is unnecessary to provide an additional ground member, which contributes to the downsizing of the light source apparatus 100.

By carrying out the EMC countermeasure as described above with respect to the light source apparatus 100, it is possible to apply the light source apparatus 100 to a so-called smart house.

[Other Embodiments]

The present disclosure is not limited to the above embodiment, and various other embodiments can be implemented.

In the above embodiment, the light source unit 40 on which the LED element 45 that has the point light emission function is mounted is used as an example. The light source unit is not limited to this and may be, for example, an organic or inorganic EL (electro luminescence) element, that is, a light source unit having a surface light emission function, or a fluorescent lamp such as a CCFL (cold cathode fluorescent lighting (lamp)) having a three dimensional light emission function.

Further, the light source unit 40 has the ring shape but may have a polygonal shape having three or more sides or a linear shape (one or more linearly formed shapes). In a similar sense, the power source substrate 50 may also have one of other shapes.

In the above embodiment, the damperless speaker is used as an example of the speaker 30, but a general type speaker 30 with no magnetic fluid 38 may be used.

The void area 50*a* of the power source substrate 50 may be formed of a cutout instead of the through hole. Alternatively, the void area 50*a* may be formed with both the through hole and the cutout. In this case, the power source substrate 50 is formed into a C-letter shape. Alternatively, the power source substrate 50 may be formed into a half-ring shape. In a similar sense, the light source unit 40 may also have one of other shapes.

In the above embodiment, on one drive substrate 61, the drive circuits of the light source unit 40 and the speaker 30 are mounted, but those may be mounted on separate circuit substrates. Further, in the above embodiment, the drive substrate 61 and the control substrate 62 contained in the circuit substrates 60 are provided as different substrates, but these may be provided in a single common substrate.

In the above embodiment, the receiving unit 628 for the infrared signal is mounted on the control substrate 62 but may be mounted on the drive substrate 61. Alternatively, it is not always necessary to provide the receiving unit 628 for the infrared signal from the remote controller.

In the above embodiment, the user controlled the remote controller so as to control for turning-on and -off, dimming, toning and the like of the light source unit 40, by the infrared signal from the remote controller. However, such a control for the light source unit 40 may be performed by a radio signal. For example, the network control circuit 627 may function as a control circuit for controlling the LED drive circuit 614 (see FIG. 7) as a light source drive circuit, on the basis of the radio signal received by the antenna 626. This allows the lighting function of the electric light bulb type light source apparatus to be controlled by radio signal information. As a result, without needing any dedicated remote controller, it makes it possible to control dimming, or the like, of the light source apparatus, for example, via the radio communication by a terminal device which is operated by a user. It may thus be applied to a so-called smart house. It is of course possible that the network control circuit 627 is configured to control both of the audio AMP 613 and the LED drive circuit 614 on the basis of information of the radio signal received by the antenna 626.

The light source apparatus according to the above embodiment is provided with the speaker but may be provided with other devices instead of the speaker. Examples of the other devices include an image sensor, an optical sensor, an ultrasonic sensor, a radiation sensor, and a temperature sensor. The antenna illustrated in the above embodiment has a function of receiving a radio signal from the outside of the casing, but the function of this antenna may also include a function of sending a radio signal to the outside of the casing. For example, in cases where the light source apparatus is provided with a sensor as the other device, the light source apparatus may be configured to send a radio signal to an external apparatus on the basis of the information sensed by the sensor. In such cases, by applying the above embodiment, it is possible to realize high communication sensitivity of the antenna.

Out of the characteristic parts of the embodiments described above, at least two characteristic parts can be combined.

The present disclosure can take the following configurations.

(1) An electric light bulb type light source apparatus, including:

a light source unit having a void area;

a casing configured to house the light source unit, the casing having a conductive outer case forming a first area in the casing and a translucent cover forming a second area in the casing, the second area being opposed to the first area, the translucent cover being opposed to the conductive outer case;

a circuit substrate at least having an antenna mounted thereon, the antenna being configured to receive a radio signal from an outside of the casing, the circuit substrate being housed in the casing, the circuit substrate being provided penetrating through the void area in such a manner that the antenna is disposed in the second area;

a base used for supplying power to the light source unit, the base being disposed on a side of the conductive outer case, which side is opposite to a side on which the translucent cover is provided.

(2) The electric light bulb type light source apparatus according to (1), further including:

a speaker; and a speaker drive circuit configured to drive the speaker by the power supplied from the base.

(3) The electric light bulb type light source apparatus according to (2), in which the circuit substrate has a control circuit mounted thereon, the control circuit being configured to at least control the speaker drive circuit on the basis of the radio signal received by the antenna, the speaker drive circuit being configured to drive the speaker on the basis of sound information contained in the radio signal received by the antenna.

(4) The electric light bulb type light source apparatus according to any one of (1) to (3), further including a light source drive circuit configured to drive the light source unit;

the circuit substrate having a control circuit mounted thereon, the control circuit being configured to at least control the light source drive circuit on the basis of the radio signal received by the antenna.

(5) The electric light bulb type light source apparatus according to any one of (1) to (4), in which the light source unit includes a mounting substrate having a light source element mounted thereon, the mounting substrate having a through hole as the void area.

(6) The electric light bulb type light source apparatus according to (5), in which the light source unit has an LED (light emitting diode) or an EL (electro luminescence) element as the light source element.

DESCRIPTION OF REFERENCE SYMBOLS

10 casing
11 translucent cover
12 base casing (conductive outer case)
15 base
30 speaker
40 light source unit
40*a* void area
45 LED element (light source element)
46 mounting substrate
60 circuit substrate
613 audio AMP (speaker drive circuit)
614 LED drive circuit (light source drive circuit)
62 control substrate (circuit substrate)
626 antenna
627 network control circuit (control circuit)

The invention claimed is:

1. An electric light bulb type light source apparatus, comprising:

a light source unit having a void area;

a casing configured to house the light source unit, the casing having a conductive outer case forming a first area in the casing and a translucent cover forming a second area in the casing, the second area being opposed to the first area, the translucent cover being opposed to the conductive outer case;

a substrate containing box containing a plurality of circuit substrates, wherein the plurality of circuit substrates are disposed spaced apart along parallel planes and with empty space there between, wherein at least one of the plurality of circuit substrates has an antenna mounted thereon, the antenna being configured to receive a radio signal from an outside of the casing, the plurality of circuit substrates being housed in the casing, the plurality of circuit substrates penetrating through the void area in such a manner that the antenna is disposed in the second area; and a base used for supplying power to the light source unit, the base being disposed on a side of the conductive outer case, which side is opposite to a side on which the translucent cover is provided.

2. The electric light bulb type light source apparatus according to claim 1, further comprising:

a speaker; and a speaker drive circuit configured to drive the speaker by the power supplied from the base.

3. The electric light bulb type light source apparatus according to claim 2, wherein one of the plurality of circuit substrates has a control circuit mounted thereon, the control circuit being configured to at least control the speaker drive circuit on the basis of the radio signal received by the antenna, the speaker drive circuit being configured to drive the speaker on the basis of sound information contained in the radio signal received by the antenna.

4. The electric light bulb type light source apparatus according to claim 1, further comprising a light source drive circuit configured to drive the light source unit, wherein one of the plurality of circuit substrates has a control circuit mounted thereon, the control circuit being configured to at least control the light source drive circuit on the basis of the radio signal received by the antenna.

5. The electric light bulb type light source apparatus according to claim 1, wherein the light source unit includes a mounting substrate having a light source element mounted thereon, the mounting substrate having a through hole as the void area.

6. The electric light bulb type light source apparatus according to claim 5, wherein the light source unit has an LED (light emitting diode) or an EL (electro luminescence) element as the light source element.

7. The electric light bulb type light source apparatus according to claim 1, wherein the plurality of circuit substrates comprises:

a control substrate and a drive substrate, wherein the antenna, an infrared receiving unit and a network control unit are mounted on the control substrate, and wherein an LED driving circuit and an audio amplifier are mounted on the drive substrate.

8. The electric light bulb type light source apparatus according to claim 1, further comprising:

a heat sink having a plate shape and covering the circumference of the void area.

9. The electric light bulb type light source apparatus according to claim 1, wherein the casing comprises a holding member having a tubular portion and a flange portion sandwiched between the first area and the second area in the casing, and wherein the substrate containing box containing the plurality of circuit substrates is disposed in an area in the tubular portion of the holding member.

* * * * *